US007202765B2

(12) United States Patent
Shen et al.

(10) Patent No.: US 7,202,765 B2
(45) Date of Patent: Apr. 10, 2007

(54) LATCHABLE, MAGNETICALLY ACTUATED, GROUND PLANE-ISOLATED RADIO FREQUENCY MICROSWITCH

(75) Inventors: Jun Shen, Phoenix, AZ (US); Rimantas L. Vaitkus, Paradise Valley, AZ (US); Gordon Tam, Gilbert, AZ (US); Meichun Ruan, Chandler, AZ (US)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/845,425

(22) Filed: May 14, 2004

(65) Prior Publication Data

US 2004/0227599 A1 Nov. 18, 2004

Related U.S. Application Data

(60) Provisional application No. 60/470,202, filed on May 14, 2003.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 4,065,677 A 12/1977 Micheron et al.
4,461,968 A 7/1984 Kolm et al.

(Continued)

FOREIGN PATENT DOCUMENTS

DE 19820821 C1 12/1999

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

E. Fullin, J. Gobet, H.A.C. Tilmans, and J. Bergvist, "A New Basic Technology for Magnetic Micro-Actuators", pp. 143-147.

(Continued)

*Primary Examiner*—Elvin Enad
*Assistant Examiner*—Bernard Rojas
(74) *Attorney, Agent, or Firm*—Sterne, Kessler, Goldstein & Fox, PLLC

(57) ABSTRACT

Radio frequency (RF) switch comprising an electromagnet formed on a magnet, a transmission line formed on the electromagnet and having a ground line and a signal line, and a movable contact connected to either the ground line or the signal line and capable of electrically coupling the ground line with the signal line. The transmission line is capable of propagating a RF signal if the ground line is electrically decoupled from the signal line. Conversely, the transmission line is incapable of propagating a RF signal if the ground line is electrically coupled with the signal line. The electromagnet can comprise an electromagnetic coil, formed in a layer of dielectric material, electrically coupled to a current source. Preferably, the movable contact is capable of being magnetically actuated, and is latchable. The magnet, the electromagnet, the transmission line, and the movable contact can have dimensions at a micron order of magnitude. The transmission line can be a coplanar waveguide. The coplanar waveguide can include a ground plane positioned between a layer of dielectric material and the electromagnet. The coplanar waveguide can also include means to electrically couple the ground plane to the ground line.

19 Claims, 7 Drawing Sheets

U.S. PATENT DOCUMENTS

| | | | | |
|---|---|---|---|---|
| 4,496,211 | A | 1/1985 | Daniel | |
| 4,570,139 | A | 2/1986 | Kroll | |
| 5,016,978 | A | 5/1991 | Fargette et al. | |
| 5,048,912 | A | 9/1991 | Kunikane et al. | |
| 5,398,011 | A | 3/1995 | Kimura et al. | |
| 5,472,539 | A | 12/1995 | Saia et al. | |
| 5,475,353 | A | 12/1995 | Roshen et al. | |
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillan et al. | |
| 6,621,387 | B1 * | 9/2003 | Hopcroft | 333/262 |
| 6,639,493 | B2 * | 10/2003 | Shen et al. | 335/78 |
| 6,919,784 | B2 * | 7/2005 | Feng et al. | 335/78 |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 9927548 | | 6/1999 |

OTHER PUBLICATIONS

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: <@CWLINK:http://www-bsac.eecs.berkeley.edu/Krughick/relays/relays.html,@>http://www-bsac.eecs.berkeley.edu/Kruglick/relays/relays.html,@> on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: <@CWLINK:http://scitec.uwhichill.edu.bb/cmp/online/P10D/Lecture@>http://scitec.uwhichill.edu.bb/cmp/online/P10D/Lecture@>14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays" , Sensors and Actuators A 91 (Jul. 15, 2001), Copyright 2001 Elsevier Science B.V., pp. 346-350.

Xi-Qing Sun, K.R. Farmer, W.N. Carr,"A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: <@CWLINK:http://home.earthlink.net/-trimmerw/mems/scale.html@>http://home.earthlink.net/-trimmerw/mems/scale.html@> on Jan. 3, 2000 (adapted from article Microrobots and Micromechanical Systems by W.S.N Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 54161952, published Dec. 22, 1979, 1 page.

English-Language Abstract of WO 9927548, published Jun. 3, 1999, 1 page.

* cited by examiner

FIG. 1(a) top view

FIG. 1(b) side view

LATCHABLE, MAGNETICALLY ACTUATED, GROUND PLANE-ISOLATED RADIO FREQUENCY MICROSWITCH

CROSS-REFERENCE TO RELATED APPLICATIONS

This application claims the benefit of U.S. Provisional Patent Application No. 60/470,202, filed May 14, 2003, which is incorporated herein in its entirety by reference.

BACKGROUND OF THE INVENTION

1. Field of the Invention

The present invention relates to radio frequency switches. More specifically, the present invention relates to a latchable, magnetically actuated, ground plane-isolated radio frequency microswitch.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that, when energized, causes a cantilever to make or break an electrical contact. When the magnet is de-energized, a spring or other mechanical force typically restores the cantilever to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching relays are known. The relay includes a permanent magnet and an electromagnet for generating a magnetic field that intermittently opposes the field generated by the permanent magnet. This relay must consume power in the electromagnet to maintain at least one of the output states. Moreover, the power required to generate the opposing field would be significant, thus making the relay less desirable for use in space, portable electronics, and other applications that demand low power consumption.

Furthermore, microwave switches have been realized in mechanical or semiconductor technologies. While mechanical switches are characterized by low signal loss and good isolation, they have slow switching speeds, consume considerable power, and are bulky. Conversely, while semiconductor switches (e.g., Field Effect Transistors, Positive-Intrinsic-Negative diodes, etc.) enjoy high switching speeds, low power consumption, and compactness, in their ON states they contribute to signal loss, and in their OFF positions they suffer from inferior isolation. They also have limited switching current capacities. Although developed for microwave frequencies, these switches can be used throughout the radio frequency (RF) spectrum.

However, the development of MEMS has yielded an opportunity to realize RF switches that capitalize on the desirable features of both mechanical and semiconductor switches, while limiting the unwanted characteristics of these earlier technologies. Particularly, a bi-stable, latching switch that does not require power to hold the states is desired. Such a switch should also be reliable, simple in design, low-cost and easy to manufacture, and should be useful in RF, optical, and/or electrical environments.

BRIEF SUMMARY OF THE INVENTION

The radio frequency (RF) switch of the present invention comprises an electromagnet formed on a magnet, a transmission line formed on the electromagnet and having a ground line and a signal line, and a movable contact connected to either the ground line or the signal line and capable of electrically coupling the ground line with the signal line. The transmission line is capable of propagating a RF signal if the ground line is electrically decoupled from the signal line. Conversely, the transmission line is incapable of propagating a RF signal if the ground line is electrically coupled with the signal line. The electromagnet can comprise an electromagnetic coil, formed in a layer of dielectric material, electrically coupled to a current source.

Preferably, the movable contact is capable of being magnetically actuated, and is latchable. However, non-latching embodiments are envisioned. Also, the magnet, the electromagnet, the transmission line, and the movable contact can have dimensions at a micron order of magnitude.

The transmission line can be a coplanar waveguide. The coplanar waveguide can comprise a layer of dielectric material formed on the electromagnet. The signal line, a first ground line, and a second ground line can be formed on the layer of dielectric material. The signal line can be positioned between the first ground line and the second ground line. The signal line can be separated from the first ground line and the second ground line. The coplanar waveguide can further comprise a ground plane positioned between the layer of dielectric material and the electromagnet. The coplanar waveguide can also comprise means to electrically couple the ground plane to at least one of the first ground line and the second ground line.

The movable contact can be a cantilever, comprising a magnet formed on a layer of conducting material, wherein the magnet is made of a permalloy. The cantilever can be elastic. The cantilever can be supported by lateral torsion flexures. At least one of the lateral torsion flexures can be capable of electrically coupling the cantilever with the first ground line or signal line to which the movable contact is connected. The cantilever can be supported by a post, which can also be elastic. The post can be capable of electrically coupling the cantilever with the first ground line or signal line to which the movable contact is connected.

The present invention also comprises a method for propagating a RF signal from a first transmission line to a second transmission line. The method comprises the steps of: (1) connecting a latchable, magnetically actuated RF switch between the first and the second transmission lines, and (2) electrically decoupling a ground line of the latchable, magnetically actuated RF switch from a signal line of the latchable, magnetically actuated RF switch.

The present invention also comprises a method of making a latchable, magnetically actuated RF microswitch. The method comprises the steps of: (1) forming a magnet on a substrate; (2) forming an electromagnet on the magnet; (3) forming, on the electromagnet, a transmission line with a ground line and a signal line; and (4) forming a movable contact connected to one of the ground line and the signal line.

The electromagnet can be formed by: (1) depositing a first layer of a dielectric material onto the magnet; (2) depositing a layer of a sacrificial material onto the first layer of the dielectric material; (3) forming a hole in the layer of the sacrificial material, such that the hole defines the electromagnet;

and (4) depositing a conductive material in the hole. The sacrificial material can be removed and a second layer of the dielectric material can be deposited onto the first layer and the conductive material.

The transmission line can be formed by: (1) depositing a layer of a dielectric material onto the electromagnet; (2) depositing a sacrificial layer onto the layer of the dielectric material; (3) forming a first hole, a second hole, and a third hole in the layer of the sacrificial material, such that the first hole defines the ground line, the second hole defines the signal line, and the third hole defines a second ground line; and (4) depositing a conductive material in the first hole, the second hole, and the third hole, thereby forming the transmission line with the ground line, the signal line, and the second ground line. A layer of conductive material can be deposited onto the electromagnet before depositing the layer of dielectric material. The layer of dielectric material can then deposited onto the layer of conductive material. A fourth hole can be formed in the layer of the dielectric material. The fourth hole can be aligned with at least one of the first hole and the third hole. The conductive material can also deposited into the fourth hole. The sacrificial material can be removed.

The magnetically actuated, ground plane-isolated radio frequency (RF) microswitch of the present invention can be used in a wide range of RF products. The present invention has the advantages of compactness, low RF signal loss, high switching speed, low power consumption, and excellent isolation performance.

Further embodiments, features, and advantages of the present invention, as well as the structure and operation of the various embodiments of the present invention, are described in detail below with reference to the accompanying figures.

BRIEF DESCRIPTION OF THE FIGURES

The above and other features and advantages of the present invention are hereinafter described in the following detailed description of illustrative embodiments to be read in conjunction with the accompanying drawing figures, wherein like reference numerals are used to identify the same or similar parts in the similar views.

The preferred embodiment of the invention is described with reference to the figures where like reference numbers indicate identical or functionally similar elements. Also in the figures, the left most digit of each reference number identify the figure in which the reference number is first used.

DETAILED DESCRIPTION OF THE INVENTION

Figure 1:
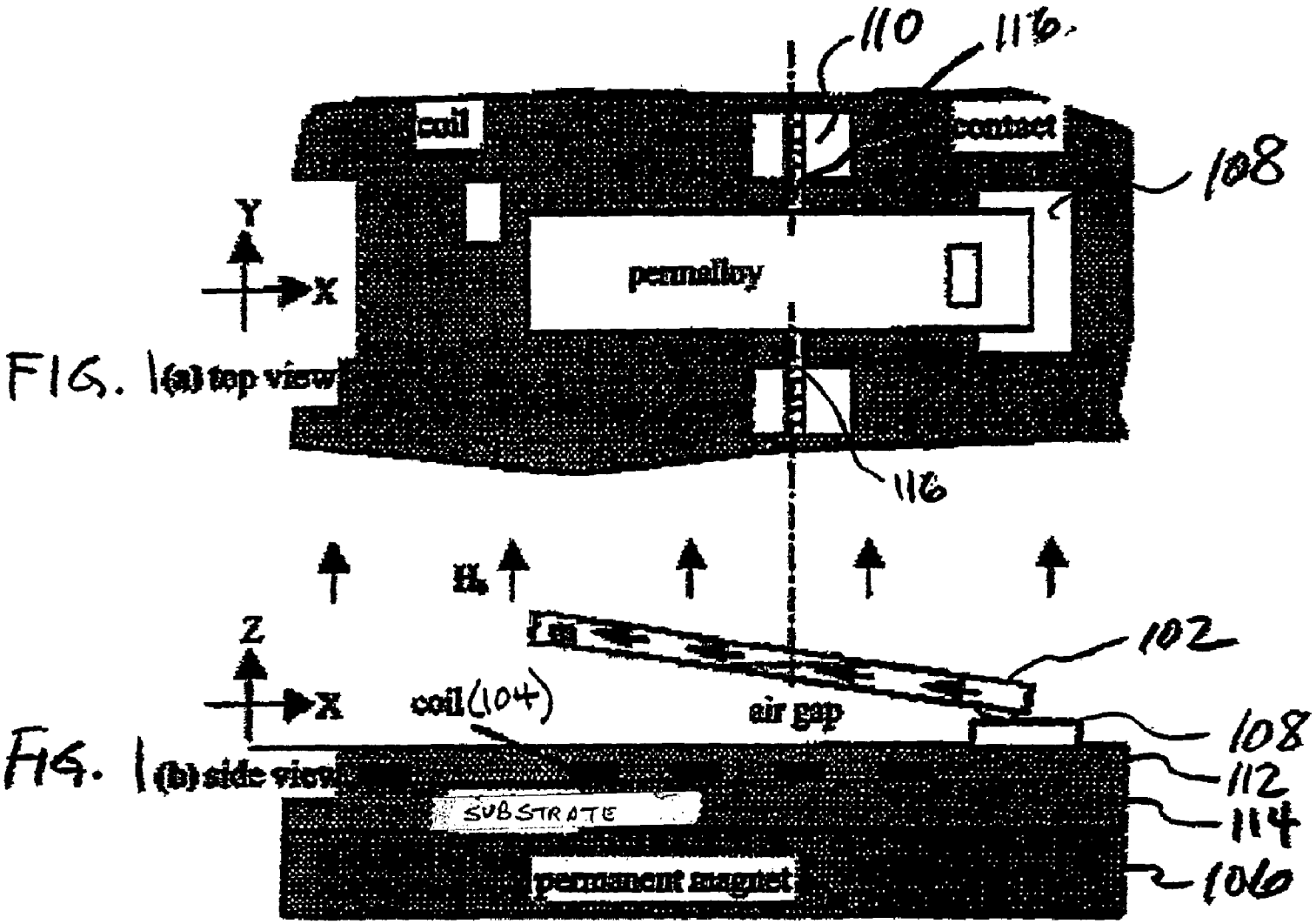
FIGS. 1A and 1B are side and top views, respectively, of an exemplary embodiment of a latching micro-magnetic switch.

It should be appreciated that the particular implementations shown and described herein are examples of the invention and are not intended to otherwise limit the scope of the present invention in any way. Indeed, for the sake of brevity, conventional electronics, manufacturing, microelectromechanical systems (MEMS) technologies and other functional aspects of the systems (and components of the individual operating components of the systems) may not be described in detail herein. Furthermore, for purposes of brevity, the invention is frequently described herein as pertaining to a microelectronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application. Moreover, it should be understood that the spatial descriptions (e.g. "above", "below", "up", "down", etc.) made herein are for purposes of illustration only, and that practical latching relays may be spatially arranged in any orientation or manner. Arrays of these relays can also be formed by connecting them in appropriate ways and with appropriate devices.

Principle of Operation

The basic structure of the microswitch is illustrated in FIGS. 1A and 1B, which include a top view and a cross sectional view, respectively. The device (i.e., switch) comprises a cantilever 102, a planar coil 104, a permanent magnet 106, and plural electrical contacts 108/110. The cantilever 102 is a multi-layer composite consisting, for example, of a soft magnetic material (e.g., NiFe permalloy) on its topside and a highly conductive material, such as Au, on the bottom surface. The cantilever 102 can comprise additional layers, and can have various shapes. The coil 104 is formed in an insulative layer 112, on a substrate 114.

Figure 2:
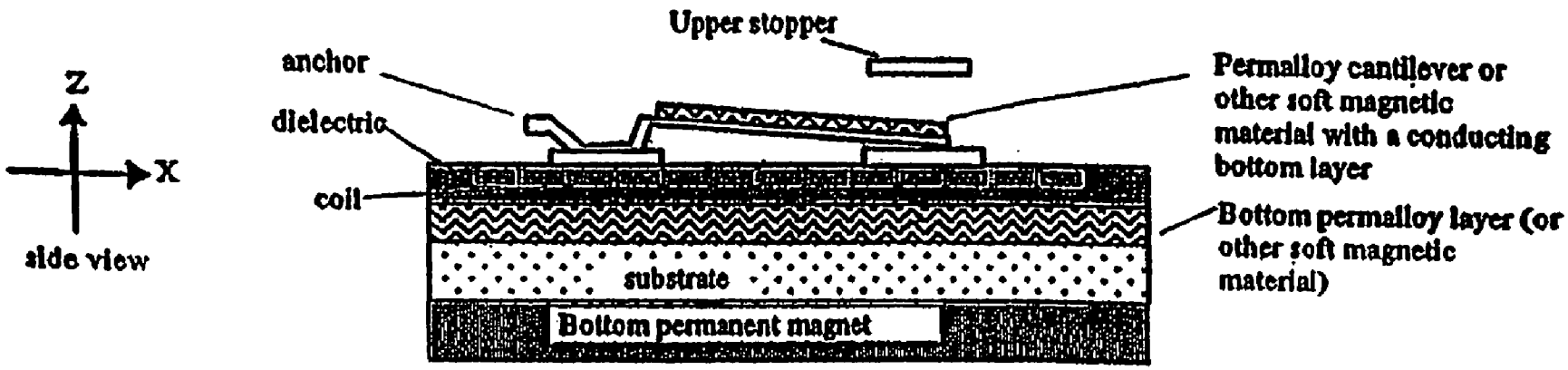
FIG. 2 illustrates a hinged-type cantilever and a one-end-fixed cantilever, respectively.

In one configuration, the cantilever 102 is supported by lateral torsion flexures 116 (see FIGS. 1 and 2, for example). The flexures 116 can be electrically conductive and form part of the conduction path when the switch is closed. According to another design configuration, a more conventional structure comprises the cantilever fixed at one end while the other end remains free to deflect (i.e., a cantilever). The contact end (e.g., the right side of the cantilever) can be deflected up or down by applying a temporary current through the coil. When it is in the "down" position, the cantilever makes electrical contact with the bottom conductor, and the switch is "on" (also called the "closed" state). When the contact end is "up", the switch is "off" (also called the "open" state). The permanent magnet holds the cantilever in either the "up" or the "down" position after switching, making the device a latching relay. A current is passed through the coil (e.g., the coil is energized) only during a brief period of time to transistion between the two states.

(i) Method to Produce Bi-Stability

Figure 3:
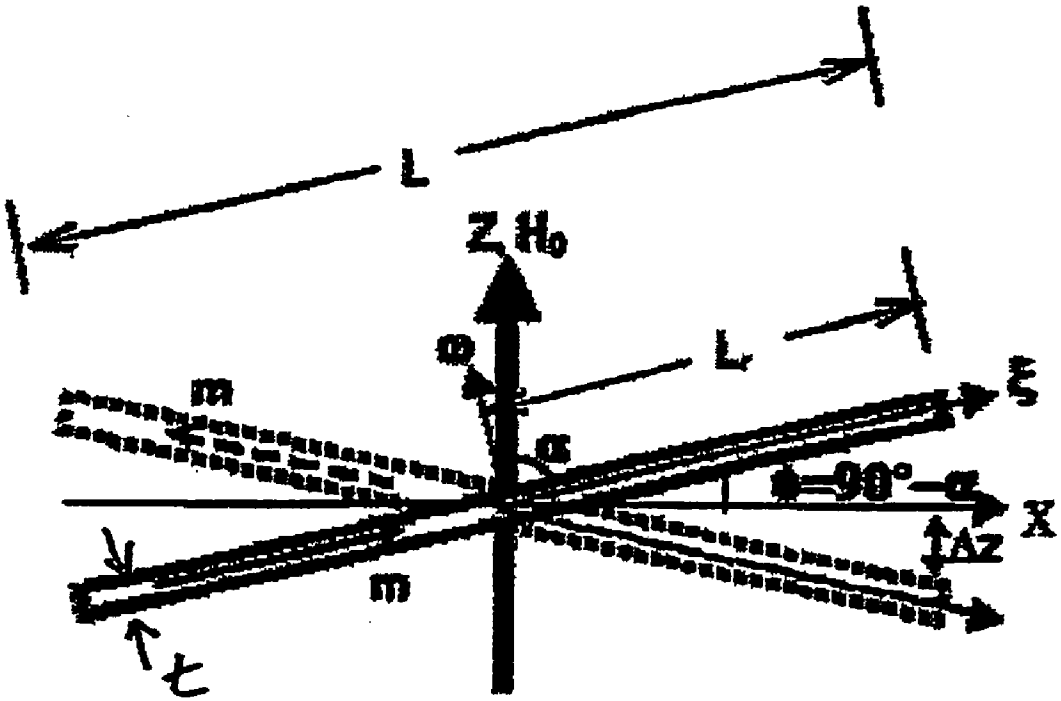
FIG. 3 illustrates a cantilever body having a magnetic moment m in a magnetic field $H_o$.

The method by which bi-stability is produced is illustrated with reference to FIG. 3. When the length L of a permalloy cantilever 102 is much larger than its thickness t and width (w, not shown), the direction along its long axis L becomes the preferred direction for magnetization (also called the "easy axis"). When such a cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field ($H_0$) is smaller than 90°, the torque is counterclockwise; and when a is larger than 90°, the torque is clockwise. The bi-directional torque arises because of the bi-directional magnetization (by $H_0$) of the cantilever (from left to right when $\alpha<90°$, and from right to left when $\alpha>90°$). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 3) of this field that is used to reorient the magnetization in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component ($H_0\xi \sim H_0 \cos(\alpha) = H_0 \sin(\phi)$, where $\alpha=90°-\phi$) of the permanent magnetic field and (p is typically very small (e.g., ($\phi$.5°), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance the torque. A coil can generate a momentary magnetic field to switch the orientation of magnetization along the cantilever and thus switch the cantilever between the two states.

The above-described latching micro-magnetic switch is further described in international patent publications WO0157899 (titled Electronically Switching Latching Micro-magnetic Relay And Method of Operating Same), and WO0184211 (titled Electronically Latching Micro-magnetic Switches and Method of Operating Same), to Shen et al. These patent publications provide a thorough background on latching micro-magnetic switches and are incorporated herein by reference in their entirety. Moreover the details of the switches disclosed in WO0157899 and WO0184211 are applicable to implement the switch of the present invention as described below.

RF Switch

The latchable, magnetically actuated, ground plane-isolated radio frequency (RF) microswitch of the present invention can be used in a wide range of RF products. The present invention has the advantages of compactness, low RF signal loss, high switching speed, low power consumption, and excellent isolation performance.

High frequencies, and their concomitant large bandwidths, make microwave signals desirable for many applications. However, because they are characterized by short wavelengths, microwave signals are not readily processed by standard electronic, lumped circuit elements (e.g., resistors, capacitors, inductors, etc.). Rather than conveying signals along a conductor, microwave transmission lines (including waveguides) function by propagating waves through a dielectric. Often the propagated wave is shaped or constrained by one or more conductors within the dielectric or on its surface. When RF signals propagating along a transmission line encounter discontinuities, mode conversion—changing the waveform from one mode to another—typically occurs. Undesirably, mode conversion can lead to RF signal loss.

Traditionally, microwave switches have been realized in mechanical or semiconductor technologies. While mechanical switches are characterized by low signal loss and good isolation, they have slow switching speeds, consume considerable power, and are bulky. Conversely, while semiconductor switches (e.g., Field Effect Transistors, Positive-Intrinsic-Negative diodes, etc.) enjoy high switching speeds, low power consumption, and compactness, in their ON positions they contribute to signal loss, and in their OFF positions they suffer from inferior isolation. They also have limited switching current capacities. Although developed for microwave frequencies, these switches can be used throughout the RF spectrum.

The development of micromechanical devices and the integration of these with microelectronics to form microelectromechanical systems, or MEMS, has yielded an opportunity to realize RF switches that capitalize on the desirable features of both mechanical and semiconductor switches, while limiting the unwanted characteristics of these earlier technologies.

Figure 4:
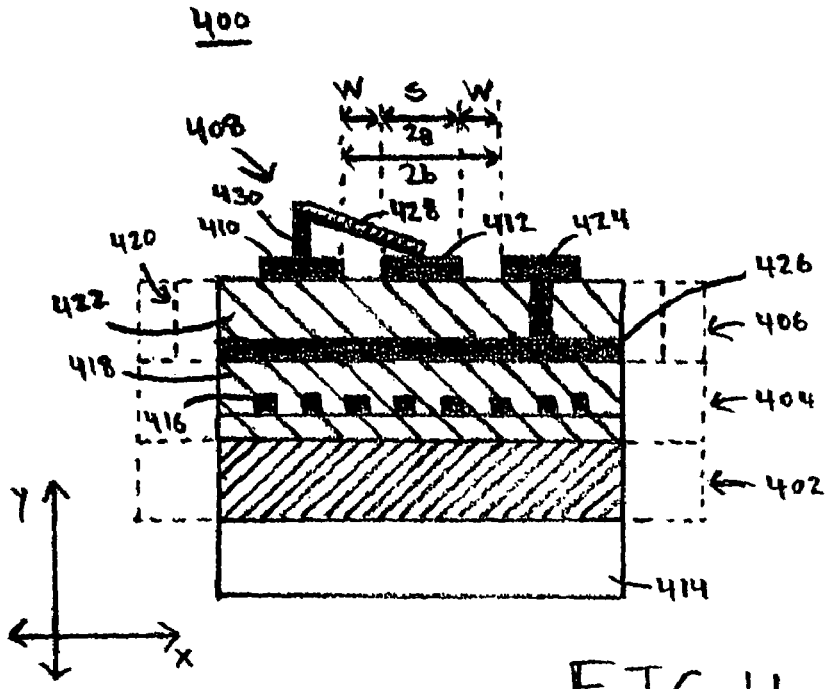
FIG. 4 shows a cross sectional view of an embodiment of a RF switch 400 in the manner of the present invention.

FIG. 4 shows a cross sectional view of an embodiment of a RF switch 400 according to the present invention. RF switch 400 comprises a magnet 402, an electromagnet 404, a transmission line 406, and a movable contact 408. In FIG. 4, the x- and y-axes are as shown, while the z-axis (not shown) extends into the page and is perpendicular to both the x- and y-axes.

Electromagnet 404 is formed on magnet 402. Transmission line 406 is formed on electromagnet 404 and has a first ground line 410 and a signal line 412. Movable contact 408 is connected to either first ground line 410 or signal line 412 and can couple first ground line 410 with signal line 412.

Transmission line 406 can propagate a RF signal if first ground line 410 is electrically decoupled from signal line 412. Conversely, transmission line 406 cannot propagate a RF signal if first ground line 410 is electrically coupled from signal line 412.

Movable contact 408 can be magnetically actuated. Movable contact 408 can also be latchable. Magnet 402, electromagnet 404, transmission line 406, and movable contact 408 can have dimensions at a micron order of magnitude such that RF switch 400 is a RF microswitch. Magnet 400 can be formed on a substrate 414, and can be made of permalloy.

In an embodiment of the present invention, electromagnet 404 comprises an electromagnetic coil 416 formed in a layer of dielectric material 418. Via holes in the layer of dielectric material 418 enable a conductor (not shown) to electrically couple electromagnetic coil 416 to a current source (not shown). The skilled artisan will appreciate other means by which electromagnetic coil 416 can be coupled to the current source.

In an embodiment, transmission line 406 is a coplanar waveguide 420. Coplanar waveguide 420 comprises a layer of dielectric material 422 formed on electromagnet 404. Signal line 412, first ground line 410, and a second ground line 424 are formed on the layer of dielectric material 422. Signal line 412 is positioned between first ground line 410 and second ground line 424. Signal line 412 is separated from each of first ground line 410 and second ground line 424. Typically, signal line 412 has a width "S" and is separated from each of first ground line 410 and second ground line 424 by a distance "W". The total separation between first ground line 410 and second ground line 424 is a separation "2b". Traditionally, width S is expressed as a width "2a". The characteristic impedance of coplanar waveguide 420 can be expressed as shown in Eq. (1):

$$Z_0=\{30\pi/(\epsilon_{eff})^{1/2}\}\{(K(k_0')/K(k_0)\}$$

where:

K is the elliptic integral function, $k_0=S/(S+2W)$, $k_0'=(1-k_0^2)^{1/2}$, and $\epsilon_{eff}$ is expressed as shown in Eq. (2):

$$\epsilon_{eff}=(1+\{(\epsilon_r-1)K(k_1)K(k_0')\}/\{2K(k_1')K(k_0)\}),$$

where:

$\epsilon_r$ is the relative permittivity of the dielectric material of the layer of dielectric material 422, $k_1=\sin h(\pi S/2h)/\sin h\{\pi(S+2W)/4h\}$, and $k_1'=(1-k_1^2)^{1/2}$.

Figure 5:
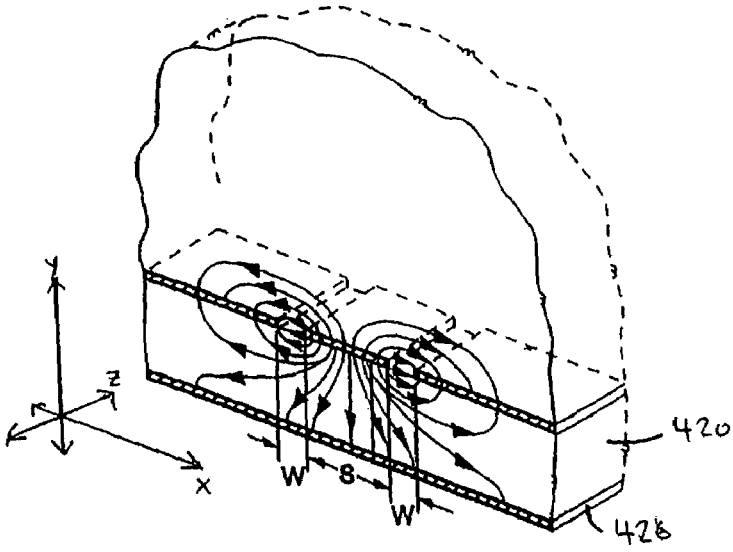
FIG. 5 shows an angled view of an electric field distribution of a wave signal propagating in coplanar waveguide 420 with ground plane 426.

In another embodiment, coplanar waveguide 420 further comprises a ground plane 426 positioned between the layer of dielectric material 422 and electromagnet 404. FIG. 5 shows an angled view of an electric field distribution of a wave signal propagating in coplanar waveguide 420 with ground plane 426. The wave signal propagates along the z-axis. Returning to FIG. 4, the characteristic impedance of coplanar waveguide 420 with ground plane 426 can be expressed as shown in Eq. (3):

$$Z_{0gp}=\{60\pi/(\epsilon_{effgp})^{1/2}\}(1/\{(K(k)/K(k')+K(k_3)/K(k_3')\}),$$

where:

$k=a/b$, $k_3=\tan h(\pi a/2h)/\tan h(\pi b/2h)$, $k'=(1-k^2)^{1/2}$, $k_3'=(1-k_3^2)^{1/2}$, and $\epsilon_{effgp}$ is expressed as shown in Eq. (4):

$$\epsilon_{effgp}=\{1+\epsilon_r K(k')K(k_3)/K(k)K(k_3')\}/\{1+K(k')K(k_3)/K)(k)K(k_3')\}.$$

A comparison of Eq. (1) with Eq. (3) shows that, for the same values of S and W, coplanar waveguide 420 with ground plane 426 has a lower characteristic impedance than coplanar waveguide 420 without ground plane 426. RF signal loss associated with mode conversion can occur where RF signals are transferred from one transmission line to another. In this situation, RF signal loss is a function of the difference between the characteristic impedances of the two transmission lines. Thus, for given values of S and W, it is desirable to have low values of characteristic impedance. This will likely limit the difference between the characteristic impedances of two connected transmission lines and, consequently, reduce RF signal loss.

Coplanar waveguide 420 with ground plane 426 can further comprise via holes in the layer of dielectric material 422 enable a conductor (not shown) to electrically couple ground plane 426 to at least one of first ground line 410 and second ground line 424. The skilled artisan will appreciate other means by which ground plane 426 can be coupled to at least one of first ground line 410 and second ground line 424. Experiments by the inventors have shown that electrically coupling ground plane 426 to at least one of first ground line 410 and second ground line 424 acts to reduce rectangular waveguide modes, spurious parallel plate modes, and mode conversion.

In an embodiment, movable contact 408 is a cantilever 428. Cantilever 428 comprises a magnet (described above) formed on a layer of conducting material (described above). Preferably, the magnet is made of permalloy. Cantilever 428 can be elastic. Cantilever 428 can be supported by lateral torsion flexures (described above). At least one of the lateral torsion flexures is capable of electrically coupling cantilever 428 with first ground line 410 or signal line 412 to which movable contact 408 is connected. Alternatively, cantilever 428 is supported by a post 430. Post 430 can be elastic. Post 430 is capable of electrically coupling cantilever 428 with first ground line 410 or signal line 412 to which movable contact 408 is connected.

Advantageously, the present invention allows RF switch 400 to be directly coupled to input and output transmission lines without discontinuities. For example, because electromagnet 404 is positioned beneath movable contact 408, transmission line 406 of RF switch 400 can be directly coupled to input and output transmission lines without discontinuities. In contrast, if electromagnet 404 was positioned so as to surround movable contact 408, there would be discontinuities between transmission line 406 of RF 400 switch and an input transmission line, and between transmission line 406 of RF 400 switch and an output transmission line. Such discontinuities might require the use of bonding wires or other means to bridge a propagating RF signal from the input transmission line across electromagnet 404 to transmission line 406 of RF 400 switch, and from transmission line 406 of RF 400 switch across electromagnet 404 to the output transmission line. Because such a configuration requires changes in the transmission media of the RF signal, the configuration could cause mode conversions and their associated RF signal losses. The present invention avoids the possibility of RF signal losses due to mode conversions.

Furthermore, where movable contact 408 consumes a given area of substrate 414 in the x-z plane, having electromagnet 404 positioned in a configuration that surrounds movable contact 408 would cause RF switch 400 overall to consume a larger area of substrate 414. In contrast, by positioning electromagnet 404 beneath movable contact 408, the present invention limits the area of substrate 414 consumed by RF switch 400 to be comparable to that of movable contact 408. Where electromagnet 404 is realized as electromagnetic coil 416, electromagnetic coil 416 can be shorter in length. A shorter length electromagnetic coil 416 can consume less power.

Additionally, ground plane 426 isolates the propagating RF signal from electromagnet 404, magnet 402, and substrate 414. Particularly, where RF switch 400 is latchable, electromagnet 404 is energized only to change the position of movable contact 408. This limits the strength of the magnetic field to which the propagating RF signal is exposed and limits the power consumed by RF switch 400.

(i) Method for Coupling a RF Signal Between Transmission Lines

Figure 6:
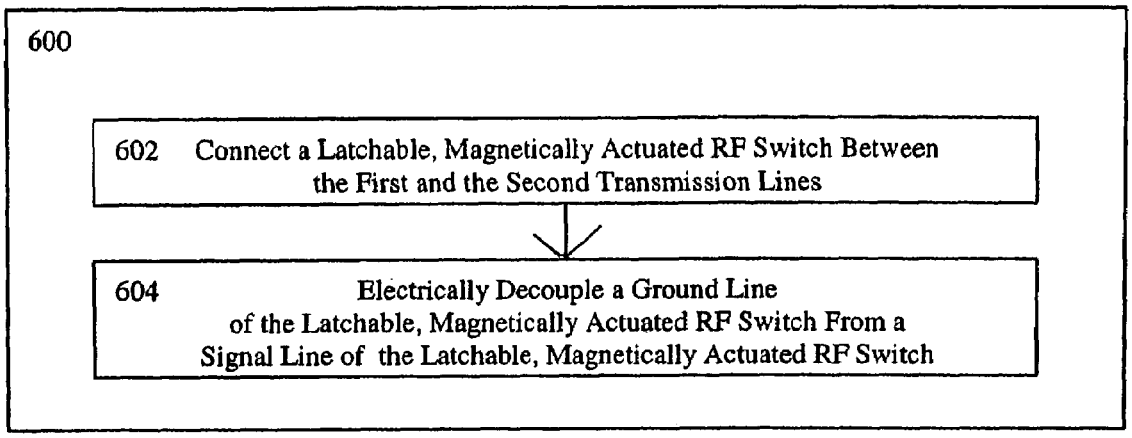
FIG. 6 shows a flow chart of a method 600 for coupling a RF signal from a first transmission line to a second transmission line.

FIG. 6 shows a flow chart of a method 600 for coupling a RF signal from a first transmission line to a second transmission line. In method 600, at a step 602, a latchable, magnetically actuated RF switch is connected between the first and the second transmission lines. At a step 604, a ground line of the latchable, magnetically actuated RF switch is electrically decoupled from a signal line of the latchable, magnetically actuated RF switch.

(ii) Method of Making a Latchable, Magnetically Actuated RF Microswitch

Figure 7:
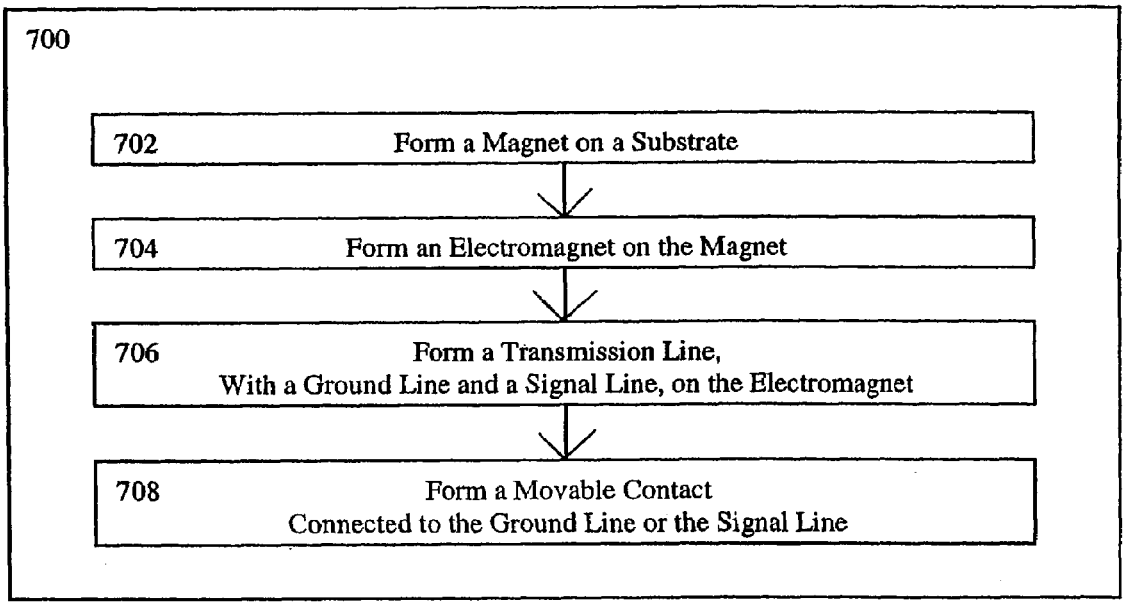
FIG. 7 shows a flow chart of a method 700 of making a latchable, magnetically actuated RF microswitch.

FIG. 7 shows a flow chart of a method 700 of making a latchable, magnetically actuated RF microswitch. In method 700, at a step 702, a magnet is formed on a substrate. The magnet can be formed by depositing a soft magnetic material onto the substrate. At a step 704, an electromagnet is formed on the magnet. At a step 706, a transmission line, with a ground line and a signal line, is formed on the electromagnet. At a step 708, a movable contact, connected to the ground line or the signal line, is formed.

Figure 8:
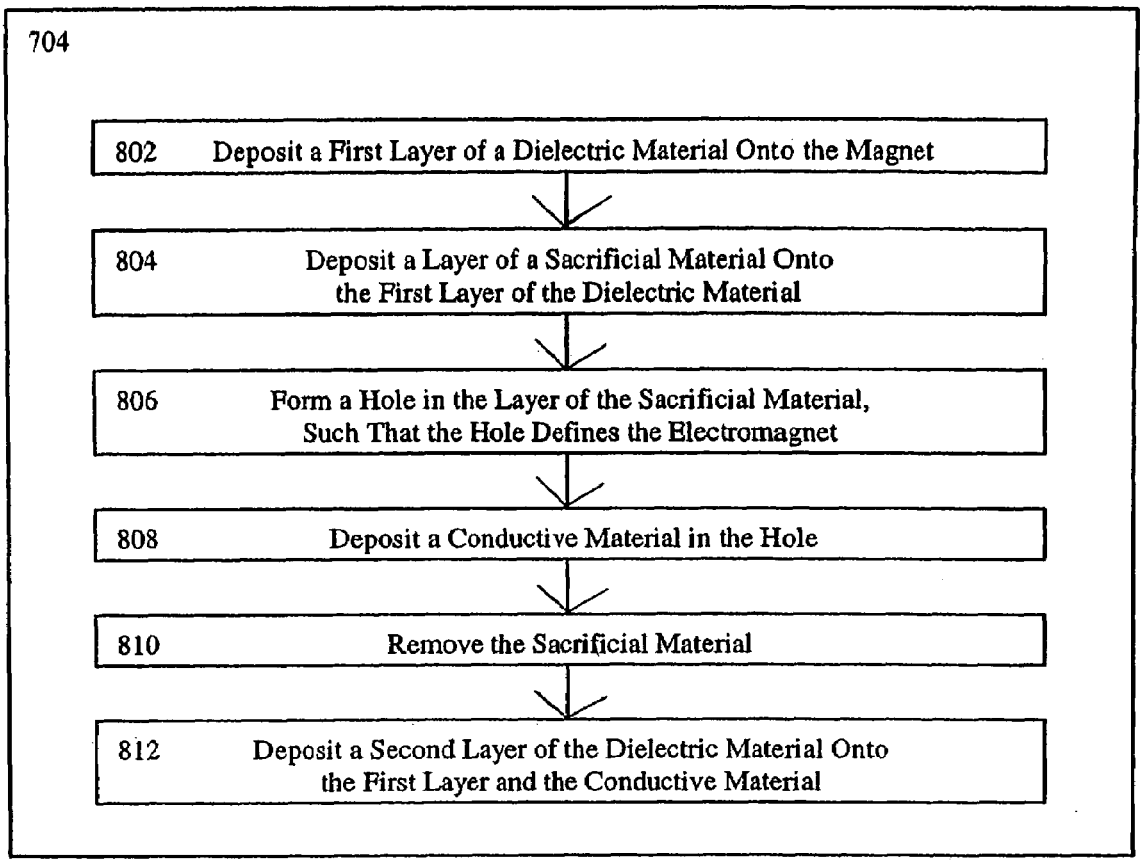
FIG. 8 shows a flow chart of a preferred method of forming the electromagnet.

To further explain step 704, FIG. 8 shows a flow chart of a preferred method of forming the electromagnet. At a step 802, a first layer of a dielectric material is deposited onto the magnet. At a step 804, a layer of a sacrificial material is deposited onto the first layer of the dielectric material. At a step 806, a hole is formed in the layer of the sacrificial material, such that the hole defines the electromagnet. At a step 808, a conductive material is deposited in the hole. Optionally, at a step 810, the sacrificial material is removed. Optionally, at a step 812, a second layer of the dielectric material is deposited onto the first layer and the conductive material.

Figure 9:
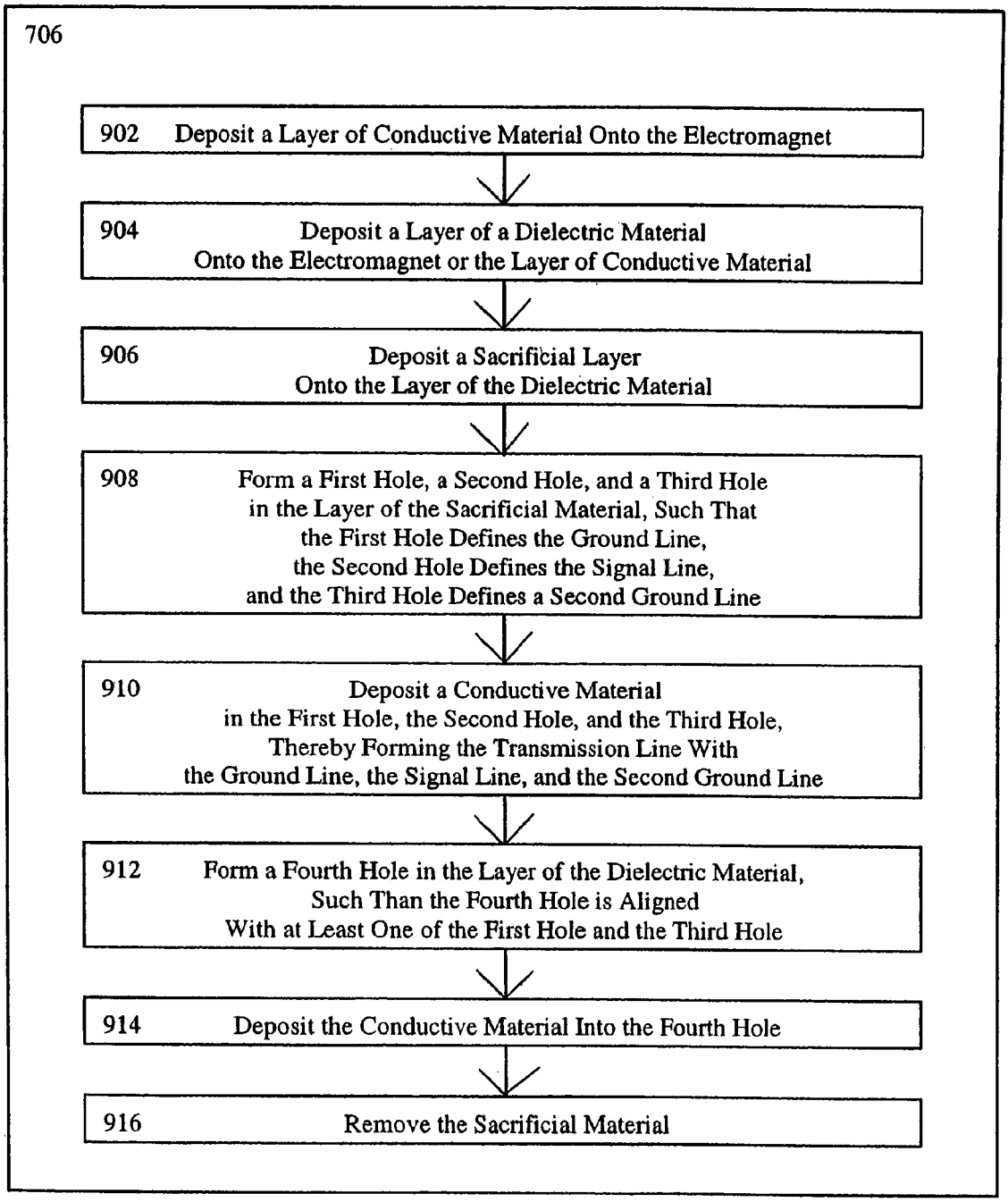
FIG. 9 shows a flow chart of a preferred method of forming the transmission line.

To further explain step 706, FIG. 9 shows a flow chart of a preferred method of forming the transmission line. Optionally, at a step 902, a layer of conductive material is deposited onto the electromagnet. At a step 904, a layer of a dielectric material is deposited onto the electromagnet or the layer of conductive material. At a step 906, a sacrificial layer is deposited onto the layer of the dielectric material. At a step 908, a first hole, a second hole, and a third hole are formed in the layer of the sacrificial material, such that the first hole defines the ground line, the second hole defines the signal line, and the third hole defines a second ground line. At a step 910, a conductive material is deposited in the first hole, the second hole, and the third hole, thereby forming the transmission line with the ground line, the signal line, and the second ground line. In one embodiment, at a step 912, a fourth hole is formed in the layer of the dielectric material. The fourth hole is aligned with at least one of the first hole and the third hole. In this embodiment, at a step 914, the conductive material is deposited into the fourth hole. Optionally, at a step 916, the sacrificial material is removed.

CONCLUSION

Although the present invention is described in relation to RF switches realized with coplanar waveguides, the skilled artisan will appreciate that the teachings of the present invention are not limited to this embodiment. The present invention can also be realized using other RF waveguide and transmission line technologies such as, but not limited to, open microstrips, covered microstrips, inverted microstrips, trapped inverted microstrips, striplines, suspended striplines, coplanar striplines, slotlines, grounded dielectric slabs, coaxial lines, two wire lines, parallel plate waveguides, rectangular waveguides, circular waveguides, ridge waveguides, dielectric waveguides, microshield lines, and coplanar waveguides suspended by membranes over micromachined grooves. Therefore, the present invention is not limited to coplanar waveguide RF switch embodiments.

Furthermore, the corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

What is claimed is:

1. A radio frequency switch, comprising:

a first magnet;

an electromagnet formed on said first magnet;

a coplanar waveguide formed on said electromagnet, said coplanar waveguide having a first ground line, a second ground line, and a signal line, wherein said coplanar waveguide comprises a first layer of dielectric material formed on said electromagnet, wherein said signal line, said first ground line, and said second ground line are formed on said first layer of dielectric material, wherein said signal line is positioned between said first ground line and said second ground line, and wherein said signal line is separated from said first ground line and said second ground line;

a movable contact connected to one of said ground line and said signal line, said movable contact capable of electrically coupling said ground line with said signal line; and a ground plane positioned between said first layer of dielectric material and said electromagnet.

2. The radio frequency switch of claim 1, wherein said coplanar waveguide is capable of propagating a radio frequency signal if said first ground line is electrically decoupled from said signal line.

3. The radio frequency switch of claim 1, wherein said coplanar waveguide is incapable of propogating a radio frequency signal if said first ground line is electrically coupled with said signal line.

4. The radio frequency switch of claim 1, wherein said movable contact is capable of being magnetically actuated.

5. The radio frequency switch of claim 1, wherein said movable contact is latchable.

6. The radio frequency switch of claim 1, wherein said first magnet, said electromagnet, said coplanar waveguide, and said movable contact have dimensions at a micron order of magnitude.

7. The radio frequency switch of claim 1, wherein said first magnet is formed on a substrate.

8. The radio frequency switch of claim 1, wherein said first magnet is made of permalloy.

9. The radio frequency switch of claim 1, wherein said electromagnet comprises:

a second layer of dielectric material;

an electromagnetic coil formed in said second layer of dielectric material; and means to couple electrically said electromagnetic coil to a current source.

10. The radio frequency switch of claim 1, further comprising means to couple electrically said ground plane to at least one of said first ground line and said second ground line.

11. The radio frequency switch of claim 1, wherein said movable contact is a cantilever.

12. The radio frequency switch of claim 11, wherein said cantilever comprises:

a layer of conducting material; and a second magnet formed on said layer of conducting material.

13. The radio frequency switch of claim 12, wherein said second magnet is made of permalloy.

14. The radio frequency switch of claim 11, wherein said cantilever is elastic.

15. The radio frequency switch of claim 11, wherein said cantilever is supported by lateral torsion flexures.

16. The radio frequency switch of claim 15, wherein at least one of said lateral torsion flexures is capable of electrically coupling said cantilever with said one of said first ground line and said signal line.

17. The radio frequency switch of claim 11, wherein said cantilever is supported by a post.

18. The radio frequency switch of claim 17, wherein said post is elastic.

19. The radio frequency switch of claim 17, wherein said post is capable of electrically coupling said cantilever with said one of said first ground line and said signal line.

* * * * *